US005284008A

United States Patent [19]

Raasch

[11] Patent Number: 5,284,008

[45] Date of Patent: Feb. 8, 1994

[54] SLIVER DELIVERY SYSTEM IN TEXTILE MACHINES THAT PROCESS SLIVER

[75] Inventor: Hans Raasch, Mönchengladbach, Fed. Rep. of Germany

[73] Assignee: W. Schlfhorst AG & Co., Moenchengladbach, Fed. Rep. of Germany

[21] Appl. No.: 801,645

[22] Filed: Dec. 2, 1991

[30] Foreign Application Priority Data

Nov. 30, 1990 [DE] Fed. Rep. of Germany ..... 4038214

[51] Int. Cl.[5] ..... D01H 13/18

[52] U.S. Cl. ..... 57/86; 57/263; 57/405

[58] Field of Search ..... 57/221, 263, 278, 352, 57/86, 87, 83, 301, 405, 136; 19/159 A, 159

[56] References Cited

U.S. PATENT DOCUMENTS

| | | | |
|---|---|---|---|
| 3,695,022 | 10/1972 | Landwehrkamp | 57/87 X |
| 4,033,104 | 7/1977 | Kamp | 57/90 X |
| 4,379,386 | 4/1983 | Goldammer et al. | 57/87 X |
| 4,735,040 | 4/1988 | Pircher | 19/159 A X |
| 4,939,895 | 7/1990 | Raasch et al. | 57/281 X |
| 4,972,669 | 11/1990 | Raasch | 57/281 |
| 4,982,563 | 1/1991 | Stahlecker | 57/83 X |
| 4,998,406 | 3/1991 | Raasch | 57/281 |

FOREIGN PATENT DOCUMENTS 3734258 4/1989 Fed. Rep. of Germany .

*Primary Examiner*—Daniel P. Stodola
*Assistant Examiner*—William Stryjewski
*Attorney, Agent, or Firm*—Herbert L. Lerner; Laurence A. Greenberg

[57] ABSTRACT

A textile machine for processing sliver includes a plurality of work stations disposed side by side. Each of the work stations has a respective fixedly assigned parking place. Sliver cans are each disposed on a respective one of the parking places behind one another in at least two rows for supplying the work stations with sliver. An automatic can changer replaces any of the sliver cans that have become empty with filled sliver cans. A device monitors contents of the sliver cans and recognizes a sliver interruption when the sliver cans are still partly full. The work stations have sliver delivery devices and the work stations include given work stations. The sliver delivery devices of the given work stations each have a device for permitting sliver supply to a respective one of the given work stations only from a sliver can located on the fixedly assigned parking place of the respective one given work station.

9 Claims, 2 Drawing Sheets

SLIVER DELIVERY SYSTEM IN TEXTILE MACHINES THAT PROCESS SLIVER

BACKGROUND OF THE INVENTION

Field of the Invention

The invention relates to a textile machine, preferably an open-end spinning machine, that processes sliver from sliver cans, including an automatic can changer for replacing cans that have become empty with filled cans, a device for monitoring the sliver can contents and for recognizing a break in the sliver if the sliver cans are still partly full, and a number of work stations disposed side by side, the sliver cans being disposed in at least two rows one behind the other, for supplying the side-by-side work stations.

In open-end spinning machines in which the sliver is delivered to the spinning stations from cans, as a rule the cans have larger dimensions than the width of a corresponding spinning station. That means that in order to utilize the space under the spinning stations, the cans typically have to be disposed in at least two rows, one behind the other. The association or assignment of the cans to the various spinning stations is defined precisely. Once set, the association of sliver cans must be strictly adhered to, especially if an automatic change of sliver cans at spinning machines is provided, otherwise proper can changing is impossible. As a rule, the slivers of the front cans and the slivers of the rear cans are delivered to the side-by-side spinning stations in alternation. Thus, as seen by looking toward the work station, the can associated with every other work station is disposed behind the cans of the adjacent work stations. The cans may be somewhat staggered behind one another, so that the rear cans are fitted into a gap between two front cans, in a super-tight packing. However, the cans may also each be disposed directly behind one another so that, for instance, two cans are located at the boundary of each of the abutting, associated spinning stations.

In order to enable initiation of an automatic can change, a sliver monitor is disposed on each spinning unit in order to issue a signal whenever there is no longer any sliver. A sliver counter is also provided, which counts backward as sliver is drawn off, for a given length of sliver. A can change is initiated automatically only when the sliver counter has run out and the sliver monitor signals an absence of sliver.

If a sliver should tear as it runs out of the can, only the sliver monitor issues a signal. The sliver counter has not yet run out, and therefore no can change is required. In that case, the operator of the machine has to intervene and put the sliver back in place.

For instance, if the sliver from a rear can has broken, then the front can first has to be moved out of the way, in order to gain access to the rear can to look for the sliver. The sliver is then picked up and introduced into the corresponding spinning station. Next, the cans have to be pushed back to their previous place. However, when the cans are returned to their previous place, the operator may transpose the positions of the cans. The can that at first was at the back may be pulled frontward, while the front can is pushed backward. The contents of the cans, each of which is ascertained by the sliver counters, will then no longer match the contents of the cans actually associated with them after the transposition has taken place. It is thus possible for the sliver counter at one spinning station to have run out while sliver is still present, since the can still contains enough sliver. On the other hand, a situation may ensue wherein the sliver has run out completely in the can while the sliver counter has not yet run down to zero. In both cases defects occur, which unnecessarily have to be taken care of by the operators. It is also possible for a can that is still sufficiently well filled with sliver to be replaced with a full can.

DESCRIPTION OF THE RELATED ART

German Published, Non-Prosecuted Application DE-OS 38 31 637 discloses an automatic can changer for an open-end automatic spinning machine that has a sliver monitor. The sliver monitor is integrated with a guide eyelet for the sliver that is disposed at each spinning station and spaced apart from a sliver inlet point. If sliver is absent and the sliver counter has run out, a can change is initiated. The cans are located side by side and therefore need not be moved in order to take care of a sliver break.

However, if the sliver cans are disposed one behind the other in at least two rows for reasons of space in a spinning machine with such a can changer, then the above-described difficulties may ensue when the location of a sliver can is mistakenly changed.

SUMMARY OF THE INVENTION

It is accordingly an object of the invention to provide a sliver delivery system in textile machines that process sliver, which overcomes the hereinafore-mentioned disadvantages of the heretofore-known devices of this general type and which avoids mistakenly changing the location of the sliver cans in textile machines having an automatic can changer during an individual servicing intervention.

With the foregoing and other objects in view there is provided, in accordance with the invention, a textile machine, preferably an open-end spinning machine, for processing sliver, comprising a plurality of work stations disposed side by side, each of the work stations having a respective fixedly assigned parking place, sliver cans each being disposed on a respective one of the parking places behind one another in at least two rows for supplying the work stations with sliver, an automatic can changer for replacing any of the sliver cans that have become empty with filled sliver cans, a device for monitoring contents of the sliver cans and for recognizing a sliver interruption when the sliver cans are still partly full, the work stations having sliver delivery means, the work stations including given work stations, and the sliver delivery means of the given work stations each having means for permitting sliver supply to a respective one of the given work stations only from a sliver can located on the fixedly assigned parking place of the respective one given work station.

According to the invention, one parking place for a sliver can is fixedly associated with each work station, and each work station has sliver delivery means that prevent the introduction of sliver from a sliver can that was incorrectly associated with that work station.

In accordance with another feature of the invention, the at least two rows of the sliver cans are first and second rows; the work stations have sliver entry locations; the sliver delivery means are guide eyelets for sliver each being disposed upstream of the sliver entry location at a respective one of the work stations; the sliver cans on the parking places of the given work stations are disposed in the first row; the means for permitting sliver supply of the guide eyelets of the given work stations are catch notches; the yarn eyelets each have a given location at which a deflection of the sliver takes place in a direction toward the parking places of the sliver cans disposed at least in the second row; and the catch notches are each disposed at a given one of the locations.

Therefore, the guide eyelets that are used as the sliver delivery means according to the invention are equipped with catch notches at the work stations, at which the sliver is supposed to enter from a sliver can in the frontmost row, rather than from a sliver can that is in a rear row which is offset from the work station, or in other words from an incorrectly positioned can. Since one sliver can is associated with every other work station and is located behind the parking places for the cans of the adjacent work stations, the work stations that adjoin these work stations alternating with them and that have cans that are in the first row, are equipped with guide eyelets that have a catch notch. In these work stations, the sliver can as a rule is located directly under the guide eyelet. The sliver thus runs virtually vertically into the guide eyelet. If this kind of sliver can should mistakenly be shifted in position from the front side of the machine out of the first row behind the work station, for instance when sliver travel is re-established after a sliver band breaks, then the sliver is deflected at the edge of the guide eyelet. At the guide eyelet according to the invention, the sliver enters the catch notch. Since the catch notch narrows in a V in the direction of the delivery of sliver, the sliver is pulled into the bottom of the notch and tears off upon resumption of operation of the work station. This causes a defect report at the work station because of the absence of sliver, and the operator is thus made aware of the error in the transposed cans and can correct it.

The guide eyelets on every other work station, at which the sliver cans are located at parking places in the second row, have no catch notch. In them, the sliver has to be deflected on the bottom edge of the guide eyelet.

In accordance with a further feature of the invention, the catch notches extend substantially parallel to an intended direction of travel of the sliver, and the catch notches are open in a direction opposite to the intended direction of travel of the sliver. Since the catch notches extend substantially parallel to the intended travel direction of the sliver, when the sliver enters properly, it cannot catch in the catch notch. If the sliver is then directed from its intended travel direction, because of an improper change in position of a can, it catches in the catch notch.

In accordance with an added feature of the invention, each of the guide eyelets have a slit formed therein as a continuation of one of the catch notches as viewed in an intended travel direction of the sliver or yarn, the slits define walls of the guide eyelets at the slits, and the walls mesh with one another like a tongue and groove.

Due to this embodiment of the catch notch, a sliver that is deflected from its intended direction can be caught even better. Even in the case of an oblique deviation from the introduction direction and a deviation of the sliver introduction caused by a sliver can that is unfavorably positioned in the changing process, the sliver will catch securely in the slit and tear.

The tearing of the sliver as it enters the catch notch is assured if, in accordance with a concomitant feature of the invention, the edges of the catch notch are cutting edges. Through the use of the cutting edges, a virtually smooth cut of the sliver is advantageously attained, so that unraveling and thinning of the sliver does not take place over a relatively long distance. The operator can re-insert the broken sliver directly, without preparing the end of the sliver. This also makes it substantially more easy to overcome a sliver break with automatic devices.

Other features which are considered as characteristic for the invention are set forth in the appended claims.

Although the invention is illustrated and described herein as embodied in a sliver delivery system in textile machines that process sliver, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENT

Figure 1:
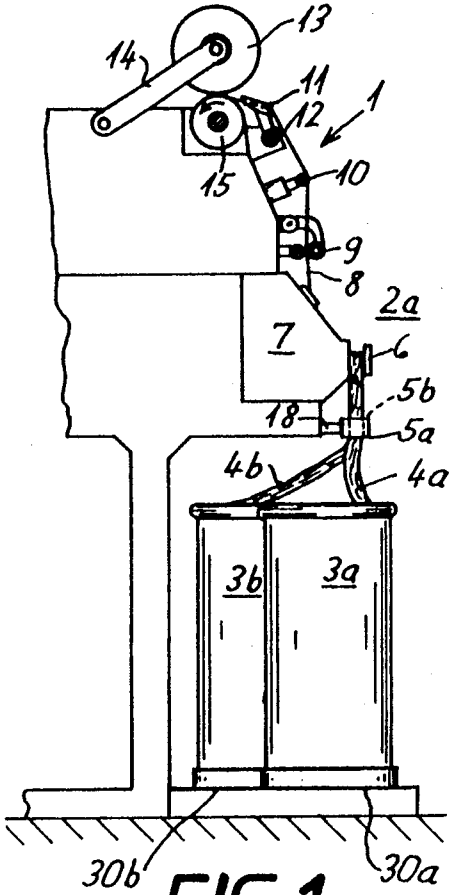
FIG. 1 is a fragmentary, diagrammatic, side-elevational view of an open-end spinning machine with guide eyelets for sliver at work stations.

Referring now to the figures of the drawing in detail and first, particularly, to FIG. 1 thereof, there is seen an open-end spinning machine as an exemplary embodiment of a textile machine that processes sliver. Only those characteristics that are necessary for comprehension of the invention are shown.

A side view of one spinning station 2a of an open-end spinning machine 1 can be seen in FIG. 1. A sliver 4a is drawn from a sliver can 3a, through a guide eyelet 5a serving as sliver delivery means, into a so-called spinning box 7, by a compressor 6. The sliver can 3a is located under the spinning station 2a on a parking place 30a. In the spinning box 7, the sliver is separated into individual fibers in a known manner, and these individual fibers are spun into a yarn 8 by means of a rotor or a pair of friction rollers.

The yarn 8 is drawn out of the spinning box 7 by means of a pair of draw-off rollers 9 and travels over a yarn storage hoop 10, which deflects the yarn, to a yarn guide 11 that is secured on a continuous yarn guide rod 12, which extends along the entire spinning machine. The yarn is wound in cross-wound layers on a cheese or cross-wound bobbin 13, which is held by a creel 14 and rests on a winding drum 15. The winding drum 15 rotates in the direction of an arrow as shown and drives the cheese 13 which is located on it by friction.

Figure 2:
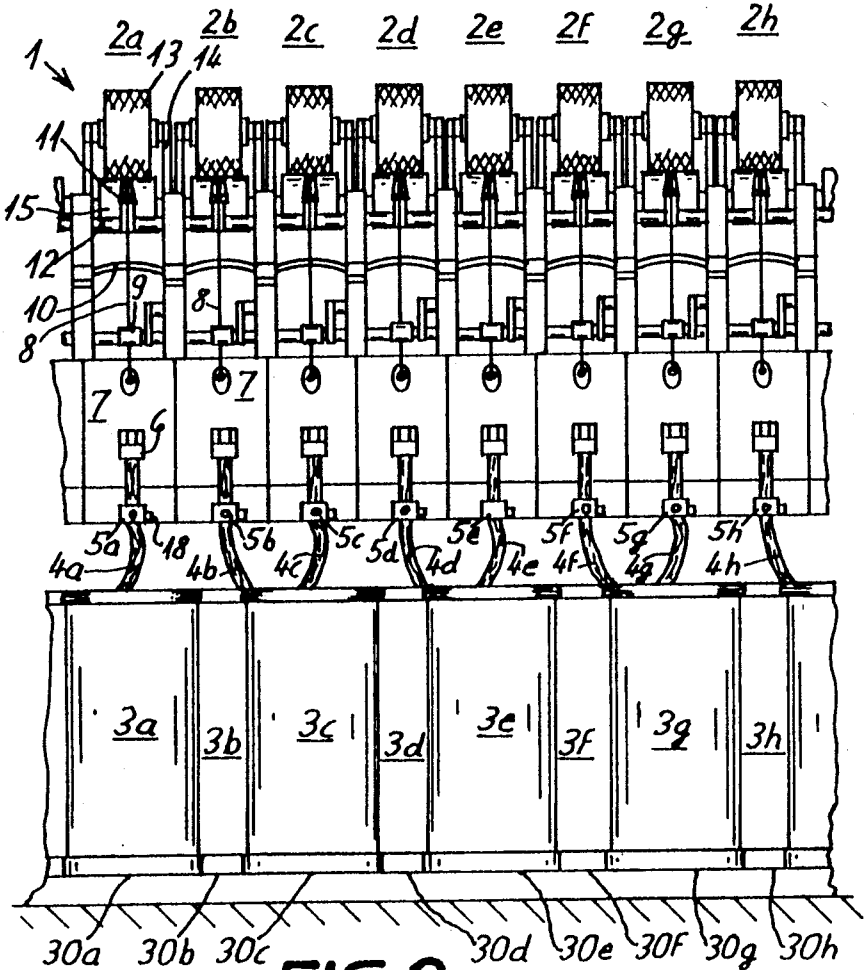
FIG. 2 is a fragmentary, front-elevational view of part of the spinning machine of FIG. 1.

As can be seen in FIG. 1, a further sliver can 3b rests on a parking place 30b. The sliver can 3b is behind the sliver can 3a and partly hidden by it. A second spinning station 2b is located behind the spinning station 2a and has the same layout as the spinning station 2a, as can be seen in FIG. 2. However, for reasons of space, the sliver can 3b assigned to the spinning station 2b is located behind the sliver can 3a and a sliver can 3c of the spinning stations adjacent to it. The sliver can 3b is located so far under the spinning box 7 on the parking place 30b, that a sliver 4b drawn out of the sliver can 3b enters a guide eyelet 5b, which is hidden by the guide eyelet 5a in FIG. 1, at an angle.

The disposition of sliver cans can be seen in FIG. 2. The sliver cans are disposed in two rows that are staggered one behind the other. The sliver can 3a and sliver cans 3c, 3e and 3g of every other following spinning station 2c, 2e and 2g, are located on parking places 30a, 30c, 30e and 30g in a first row at the front. The sliver can 3b and sliver cans 3d, 3f and 3h of every second spinning station 2b, 2d, 2f and 2h, are in a second row on parking places 30b, 30d, 30f and 30h, staggered behind the other sliver cans. While slivers 4a, 4c, 4e and 4g of the cans in the first row are drawn-in vertically from above or at an angle from the front, slivers 4b, 4d, 4f and 4h of the back sliver cans are drawn-in in such a way that the sliver abuts against the rear edge of various guide eyelets 5b, 5d, 5f and 5h.

Figure 3:
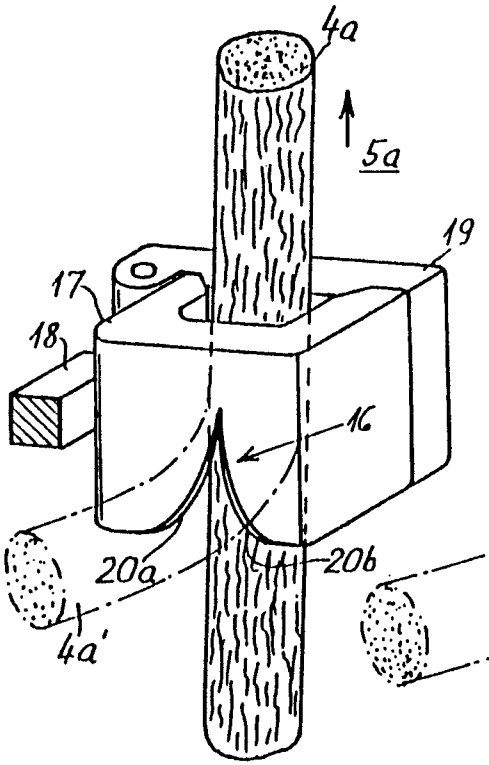
FIG. 3 is a perspective view of a guide eyelet according to the invention, having a catch notch.

In order to assure that the sliver will be pulled from the can only into the spinning station to which that can is assigned, guide eyelets 5a, 5c, 5e and 5g of the spinning stations associated with the sliver cans 3a, 3c, 3e and 3g in the front row, each have means for permitting sliver supply in the form of a catch notch 16, as shown in FIG. 3.

If one of the sliver cans 3a, 3c, 3e and 3g should mistakenly be pushed into a position associated with the rear sliver cans 3b, 3d, 3f and 3h, then the direction at which the sliver enters the respective guide eyelet also changes. With this kind of change in position of the sliver cans, the sliver would unavoidably enter the respective catch notch of the guide eyelet. Due to the tension exerted on the sliver, it would be caught in the notch and tear there. A sliver break would therefore be reported at the applicable spinning station, and the operator could correct the mistaken transposition in position of the sliver cans that had taken place.

Due to the resultant break in a sliver caused by this transposition, any automatic can change would also be prevented by an automatic can changer, which is of a known type and is therefore not shown or described in further detail herein. An operator would first have to correct the resultant mistake. This effectively prevents the can changer of an automatic can changer apparatus from being called in response to a sliver break resulting from incorrect positioning of the sliver can, so that a can that is still full will not be replaced.

FIG. 3 shows an exemplary embodiment of a guide eyelet with which the travel direction of the sliver can be monitored. In the present case, this may, for instance, be the guide eyelet 5a. The guide eyelet 5a substantially includes a U-shaped channel piece 17 for the sliver 4a, which travels from bottom to top in the direction of an arrow as shown, in order to be fed into the spinning box. This U-shaped channel piece 17 is secured to the housing of the spinning box 7 by a holder 18. The channel is closed with a lid 19, which can be opened to place the sliver in it.

If the sliver can is in its correct position, the sliver travels unhindered vertically through the guide eyelet. However, if the sliver can is displaced to the rear from its position, then the sliver is also deflected into a direction 4a'. Due to the tension on the sliver which acts in the direction of the arrow, the sliver is pulled into the catch notch 16. It becomes stuck there and finally is torn off at that point. The separation of the sliver in the catch notch is facilitated by the blade-like edges 20a and 20b.

Figure 4:
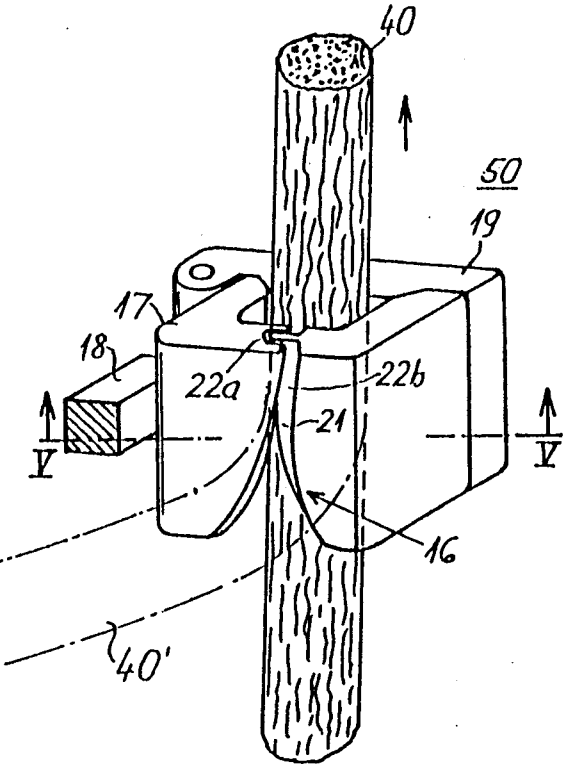
FIG. 4 is a view similar to FIG. 3 of a guide eyelet having a catch notch that continues in the form of a slit.

FIG. 4 shows another embodiment of a guide eyelet 50 of a device for monitoring the travel direction of the sliver. Characteristics that match those of the exemplary embodiment of FIG. 3 are identified by the same reference numerals. Once again, a U-shaped channel piece 17 is provided, through which the sliver 40 travels vertically in the direction of an arrow. The channel piece is likewise closable by a lid 19 and is secured to the machine with a holder 18.

Figure 5:
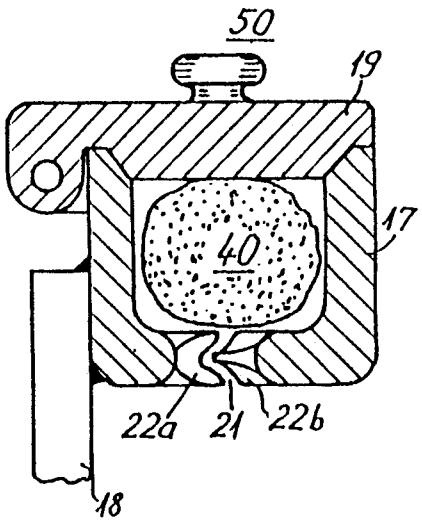
FIG. 5 is a fragmentary, sectional view of the guide eyelet of FIG. 4, which is taken along the line V—V of FIG. 4, in the direction of the arrows.

In the present exemplary embodiment, the catch notch 16 is extended in the form of a slit 21, as viewed in the direction of travel of a sliver 40. Walls 22a and 22b of the slit mesh with one another like a tongue and groove. This is particularly clearly shown in FIG. 5, which is a section taken through the guide eyelet of FIG. 4 at an indicated point, with the view being in the direction of travel of the sliver.

The apparatus according to the invention for monitoring the direction of travel of sliver, has been described as an exemplary embodiment in conjunction with an open-end spinning machine. However, possible uses for such apparatus exist wherever a sliver is not supposed to deviate from a direction of travel, once it has been defined. For instance, a guide eyelet of this kind can also be used in guiding slivers to make flyer bobbins.

I claim:

1. A textile machine for processing sliver, comprising a plurality of work stations disposed side by side, each of said work stations having a respective fixedly assigned parking place, sliver cans each being disposed on a respective one of said parking places behind one another in at least two rows for simultaneously supplying said respective work stations with sliver, said work stations having sliver delivery means, said work stations including given work stations, and said sliver delivery means of said given work stations each having means for permitting sliver supply to a respective one of said given work stations only from a sliver can located on said fixedly assigned parking place of said respective one given work station and for severing sliver supplied from a sliver can located on another parking place.

2. The textile machine according to claim 1, wherein said at least two rows of said sliver cans are first and second rows; said work stations have sliver entry locations; said sliver delivery means are guide eyelets for sliver each being disposed upstream of said sliver entry location at a respective one of said work stations; said sliver cans on said parking places of said given work stations are disposed in said first row; said means for permitting sliver supply of said guide eyelets of said given work stations are catch notches; said guide eyelets each have a given location at which a deflection of the sliver takes place in a direction toward said parking places of said sliver cans disposed at least in said second row; and said catch notches are each disposed at a given one of said locations.

3. The textile machine according to claim 2, wherein said catch notches extend substantially parallel to an intended direction of travel of the sliver, and said catch notches are open in a direction opposite to the intended direction of travel of the sliver.

4. The textile machine according to claim 3, wherein each of said guide eyelets have a slit formed therein as a continuation of one of said catch notches in the intended travel direction of the sliver, said slits define walls of said guide eyelets at said slits, and said walls mesh with one another like a tongue and groove.

5. The textile machine according to claim 4, wherein said catch notches have cutting edges.

6. The textile machine according to claim 3, wherein said catch notches have cutting edges.

7. The textile machine according to claim 2, wherein each of said guide eyelets have a slit formed therein as a continuation of one of said catch notches in an intended travel direction of the sliver, said slits define walls of said guide eyelets at said slits, and said walls mesh with one another like a tongue and groove.

8. The textile machine according to claim 7, wherein said catch notches have cutting edges.

9. The textile machine according to claim 2, wherein said catch notches have cutting edges.

* * * * *